US008960501B2

(12) United States Patent
Pappalardo

(10) Patent No.: US 8,960,501 B2
(45) Date of Patent: Feb. 24, 2015

(54) DISPENSING ASSEMBLY AND METHOD FOR DISPENSING A MIXED FLUID

(71) Applicant: Nordson Corporation, Westlake, OH (US)

(72) Inventor: Matthew E. Pappalardo, Ewing, NJ (US)

(73) Assignee: Nordson Corporation, Westlake, OH (US)

( * ) Notice: Subject to any disclaimer, the term of this patent is extended or adjusted under 35 U.S.C. 154(b) by 3 days.

(21) Appl. No.: 13/798,432

(22) Filed: Mar. 13, 2013

(65) Prior Publication Data

US 2014/0110435 A1 Apr. 24, 2014

Related U.S. Application Data

(60) Provisional application No. 61/717,335, filed on Oct. 23, 2012.

(51) Int. Cl.
*B67D 7/78* (2010.01)
*B01F 5/00* (2006.01)
(Continued)

(52) U.S. Cl.
CPC ..... *B01F 5/0082* (2013.01); *B01F 5/0615* (2013.01); *B01F 13/1027* (2013.01); *B01F 15/0087* (2013.01); *B05C 17/00506* (2013.01); *B05C 17/00553* (2013.01)
USPC ..... 222/145.5; 222/145.6

(58) Field of Classification Search
USPC ..... 222/145.5, 145.36, 137, 459, 145.3, 94
See application file for complete search history.

(56) References Cited

U.S. PATENT DOCUMENTS 4,538,920 A 9/1985 Drake
4,690,306 A 9/1987 Staheli
(Continued)

FOREIGN PATENT DOCUMENTS

EP 0150738 A2 8/1985
EP 0885651 A1 12/1998
(Continued)

OTHER PUBLICATIONS

Instrumentation and Control—Manual of Water Supply Practices, M2 (3rd Edition) (2001). (pp. 8-9). American Water Works Association (AWWA). Online version available at: http://app.knovel.com/hotlink/toc/id:kplCMWSPM2/instrumentation-control-2.*
(Continued)

*Primary Examiner* — J. Casimer Jacyna
*Assistant Examiner* — Benjamin R Shaw
(74) *Attorney, Agent, or Firm* — Wood, Herron & Evans, L.L.P.

(57) ABSTRACT

A dispensing assembly and method for preventing a lead-lag condition between first and second fluid components forming a mixed fluid includes a nozzle and a mixer insert connected to first and second barrels respectively containing the first and second fluid components. The nozzle has a nozzle inlet that includes first and second cavity portions. The mixer insert is positioned at least partially within the nozzle inlet to collectively define respective first and second passages. The first and second passages are adapted for directing the first and second fluid components into a nozzle bore of the nozzle for forming a pre-mixed fluid according to a predetermined ratio. The nozzle is further adapted to mix the pre-mixed fluid for dispensing the mixed fluid from the nozzle.

18 Claims, 7 Drawing Sheets

(51) Int. Cl.

| | |
|---|---|
| ***B01F 5/06*** | (2006.01) |
| ***B01F 15/00*** | (2006.01) |
| ***B05C 17/005*** | (2006.01) |
| *B01F 13/10* | (2006.01) |

(56) References Cited

U.S. PATENT DOCUMENTS

| | | | | | |
|---|---|---|---|---|---|
| 4,771,919 | A | | 9/1988 | Ernst | |
| 4,801,008 | A | | 1/1989 | Rich | |
| 5,027,981 | A | | 7/1991 | Magister | |
| 5,033,650 | A | | 7/1991 | Colin et al. | |
| 5,228,599 | A | * | 7/1993 | Keller | 222/137 |
| 5,333,760 | A | | 8/1994 | Simmen | |
| 5,458,262 | A | * | 10/1995 | Keller | 222/135 |
| 5,487,606 | A | * | 1/1996 | Keller | 366/339 |
| 5,498,078 | A | * | 3/1996 | Keller | 366/339 |
| 5,609,271 | A | | 3/1997 | Keller et al. | |
| RE36,235 | E | | 6/1999 | Keller et al. | |
| 5,918,772 | A | | 7/1999 | Keller et al. | |
| 6,161,730 | A | * | 12/2000 | Heusser et al. | 222/137 |
| 6,186,363 | B1 | | 2/2001 | Keller et al. | |
| 6,244,740 | B1 | * | 6/2001 | Wagner et al. | 366/181.5 |
| 6,769,574 | B1 | | 8/2004 | Keller | |
| 6,820,766 | B2 | | 11/2004 | Keller et al. | |
| 6,837,612 | B2 | * | 1/2005 | Bublewitz et al. | 366/172.1 |
| 7,316,330 | B2 | | 1/2008 | Muller et al. | |
| 7,387,432 | B2 | | 6/2008 | Lu et al. | |
| 2001/0004082 | A1 | * | 6/2001 | Keller et al. | 222/137 |
| 2010/0200614 | A1 | * | 8/2010 | Von Rotz et al. | 222/145.5 |

FOREIGN PATENT DOCUMENTS

| | | | |
|---|---|---|---|
| EP | 1029585 | A1 | 8/2000 |
| EP | 1588779 | A1 | 10/2005 |
| WO | 02055138 | A1 | 7/2002 |
| WO | 2006095179 | A1 | 9/2006 |
| WO | 2007041878 | A1 | 4/2007 |

OTHER PUBLICATIONS

European Patent Office, European Search Report in EP Application No. 13188430, Feb. 3, 2014.

* cited by examiner

DISPENSING ASSEMBLY AND METHOD FOR DISPENSING A MIXED FLUID

CROSS-REFERENCE TO RELATED APPLICATION

This application claims the priority of application Ser. No. 61/717,335 filed Oct. 23, 2012 (pending), the disclosure of which is hereby incorporated by reference herein.

TECHNICAL FIELD

The present invention relates generally to a dispensing assembly and method for mixing and dispensing two fluids.

BACKGROUND

In the dispensing field, it is common to mix two or more fluid components to form a mixed fluid shortly before dispensing. For example, first and second fluids, such as first and second liquid adhesive components may be mixed to form a curable liquid adhesive for application onto a workpiece or substrate. The first and second liquid components are each separately contained within a dual-chamber cartridge. A nozzle is attached to component outlets of the cartridge and pressure is applied to the first and second liquid components in order to force the first and second liquid components into the nozzle. A static mixer is also positioned within the nozzle. Accordingly, the first and second liquid components travel through the static mixer within the nozzle to dispense from a nozzle tip for application onto the workpiece or substrate. While this particular example forms a curable liquid adhesive for dispensing, any number of fluid components may be similarly mixed to create a mixed fluid that includes any variety of desirable properties for use by the end-user.

In many cases, the two or more fluid components are directed into the mixing nozzle in unequal volumes at a predetermined ratio. Thus, upon initially dispensing the fluid components from the cartridge, a lead-lag condition may occur in which the smaller volume fluid component of the predetermined ratio "lags" behind the higher volume fluid component. This lead-lag condition results in the initially dispensed fluid having an incorrect ratio of fluid components. Any mixed fluid dispensed during the initial lead-lag condition must be discarded.

Often, the cartridge outlets are in a side-by-side configuration. The side-by-side configuration produces a cross-section of fluid also having the fluid components in side-by-side contact. Thus, the fluid components remain relatively unmixed, which may greatly reduce beneficial properties of the mixed fluid. For instance, improperly mixed liquid adhesive may not effectively cure, causing partial or total failure of the adhesive in use.

In order to improve fluid component ratio accuracy and mixing of the fluid components, the static mixer may include a pre-mixer adapted to both reduce lead-lag and layer the fluid components into a pre-mixed fluid. The pre-mixed fluid then passes into the static mixer partially mixed and having more accurate fluid component ratios. However, pre-mixers often include complex geometries defining fluid paths for the fluid components that are difficult to form. Moreover, these complex geometries create significant restriction between the cartridge and the nozzle causing flow problems, especially with high viscosity fluid components.

There is a need for a dispensing assembly and method for use in dispensing a mixed fluid, such as a mixed adhesive liquid, that addresses present challenges and characteristics such as those discussed above.

SUMMARY

One exemplary embodiment of the dispensing assembly includes first and second barrels for containing first and second fluid components, a mixer insert, and a nozzle. The mixer insert has first and second mixer inlets for fluidly communicating respectively with the first and second chambers. The nozzle includes a nozzle body having a nozzle inlet and a nozzle bore extending through both the nozzle body and nozzle inlet.

In one aspect, the nozzle inlet includes first and second cavity portions adapted to receive respective first and second fluid components. The first cavity portion is configured to direct a first volume of the first fluid component into the nozzle bore. In addition, the second cavity portion is configured to direct a second volume of the second fluid component into the nozzle bore. The first volume is less than the second volume. The first and second cavity portions are also adapted to direct the first and second fluid components into the bore according to a predetermined ratio.

Furthermore, the first and second cavity portions have respective first and second cavity portion volumes. The first cavity portion volume is less than the second cavity portion volume. The first cavity portion includes a ramped slot for directing the first fluid component into the nozzle bore. In addition, the second cavity portion includes a generally conical surface for directing the second fluid component into the nozzle bore.

In another aspect, the mixer insert and the first and second cavity portions collectively define respective first and second passages. The first passage is configured to direct the first volume of the first fluid component into the nozzle bore. Similarly, the second passage is configured to direct the second volume of the second fluid component into the nozzle bore. The first and second fluid components are each directed into the nozzle bore to form a pre-mixed fluid having the predetermined ratio of first and second fluid components. In addition, the nozzle is adapted to mix the pre-mixed fluid for dispensing a mixed fluid from the nozzle.

In use, the first and second fluid components are forced through the mixer insert and into respective first and second passages. The first fluid component is forced through the first passage along a channel within the nozzle inlet into the nozzle bore. The second fluid component is forced through the second passage into the nozzle bore. The first fluid component increases in speed relative to the second fluid component while being forced through the first passage in order to generally prevent a lead-lag condition between the first and second components. The first and second fluid components are positioned adjacent to each other for forming the pre-mixed fluid. The pre-mixed fluid is then mixed into the mixed fluid and dispensed from the nozzle.

Various additional objectives, advantages, and features of the invention will be appreciated from a review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below serve to explain the invention.

DETAILED DESCRIPTION

Figure 1:
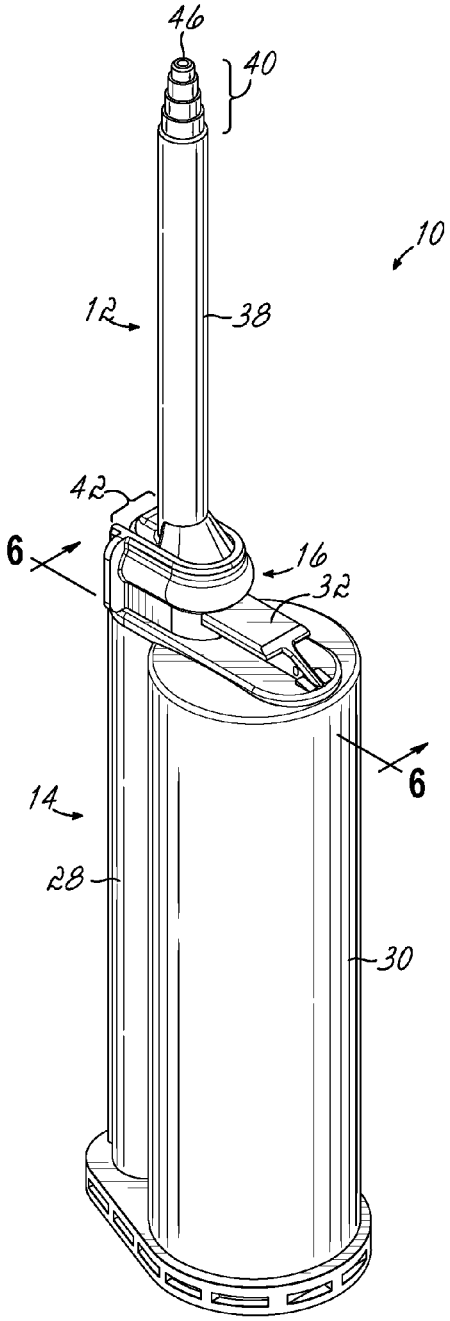
FIG. 1 is a front perspective view of a dispensing assembly according to a first embodiment of the invention.
Figure 2:
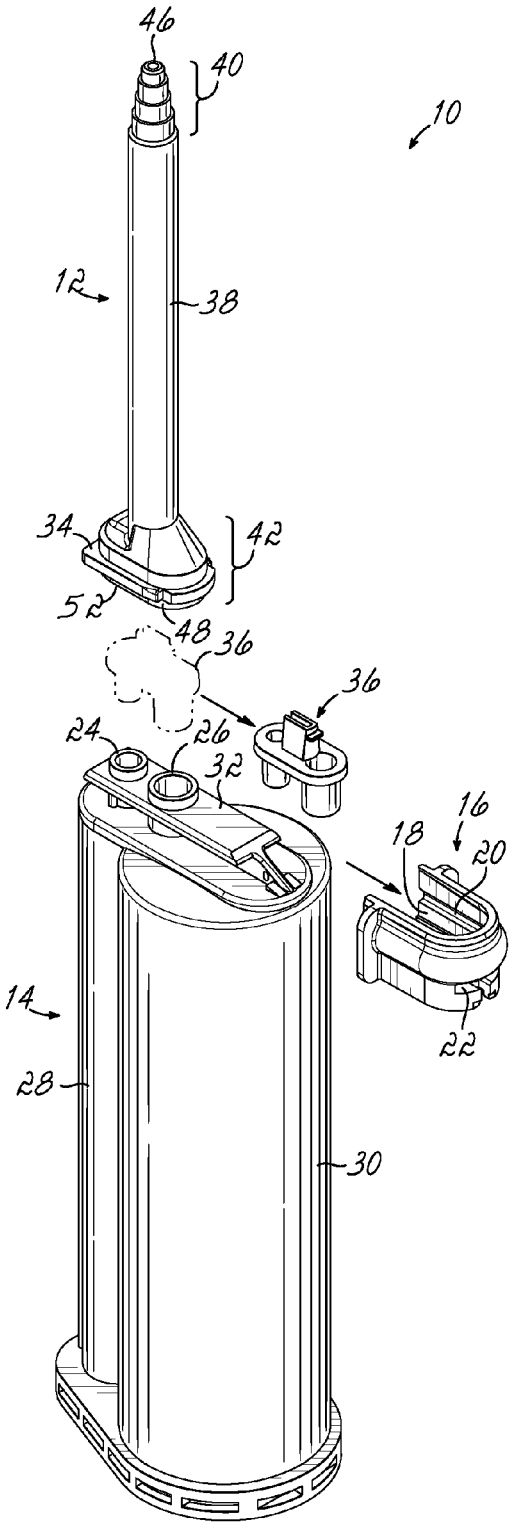
FIG. 2 is an exploded perspective view of the dispensing assembly shown in FIG. 1.

FIGS. 1 and 2 are directed to an illustrative embodiment of a dispensing assembly 10 for dispensing a mixed fluid in accordance with the principles of the invention. The term "fluid" encompasses any material that exhibits fluid-like flow characteristics. Typical fluids may include, but are not limited to, epoxies, urethanes, methacrylates, silicones, polyesters, polyvinyl siloxanes, and temporary cements. While these fluids have many uses, some exemplary uses may include bonding, potting, sealing, repairing, or forming chemical anchors, dental materials, or medical materials. With respect to the use of the terms "distal" and "proximal," it will be appreciated that such directions are intended to describe relative locations along exemplary embodiments of the dispensing assembly 10. It is not intended that the terms "distal" and "proximal" limit the invention to any of the exemplary embodiments described herein. The dispensing assembly 10 includes a nozzle 12 mounted to a cartridge 14 with a coupling 16. According to the exemplary embodiment of the invention, the coupling 16 is U-shaped having first and second slots 18, 20. The first slot 18 extends through the entirety of the coupling 16 to define a slot opening 22. The nozzle 12, the cartridge 14, and the coupling 16 are described in additional detail in co-pending U.S. patent application Ser. No. 13/669,641, filed Nov. 6, 2012, assigned to the assignee of the present invention, and the disclosure of which is hereby incorporated by reference herein.

The cartridge 14 has first and second outlets 24, 26 respectively in fluid communication with first and second barrels 28, 30. The first and second barrels 28, 30 include respective fluid components within first and second chambers 28*a*, 30*a* (see FIG. 6) and serve to isolate the two fluids prior to mixing. A mounting flange 32 is positioned adjacent to the first and second outlets 24, 26 for mounting the nozzle 12 to the cartridge 14. More particularly, the nozzle 12 is positioned adjacent to the first and second outlets 24, 26 and the coupling 16 connects the nozzle 12 to the cartridge 14 such that the first and second outlets 24, 26 are in fluid communication with the nozzle 12. Generally, the mounting flange 32 is slid into the first slot 18 and through the slot opening 22 of the coupling 16. As the coupling 16 slides along the mounting flange 32, the second slot 20 slides over a nozzle flange 34 until the coupling 16 snaps into a releasable fixed position. Accordingly, FIG. 1 shows the nozzle 12 held in sealed fluid communication with the first and second outlets 24, 26 of the cartridge 14.

With respect to FIG. 2, the coupling 16 releases from the fixed position to slide off of the flanges 32, 34 for removing the nozzle 12 from the cartridge 14. A mixer insert 36 is assembled within the nozzle 12. The mixer insert 36 is in fluid communication between the cartridge 14 and the nozzle 12 for pre-mixing the two fluid components respectively contained in the first and second barrels 28, 30. As such, the mixer insert 36 is generally positioned between and partially within both the nozzle 12 and the cartridge 14. While the exemplary embodiment of the nozzle 12, the mixer insert 36, and the cartridge 14 is assembled and connected as described above, it will be appreciated that various mechanical structures and methods may be used for placing the chambers 28*a*, 30*a* (see FIG. 6) in fluid communication with the nozzle 12 having a mixer insert 36 in fluid communication therebetween.

Figure 3A:
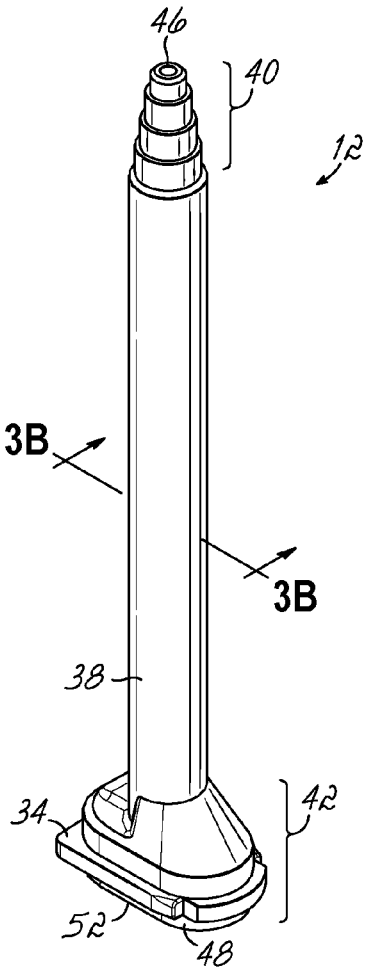
FIG. 3A is a perspective view of a nozzle according to the first embodiment of the dispensing assembly shown in FIG. 1.
Figure 3B:
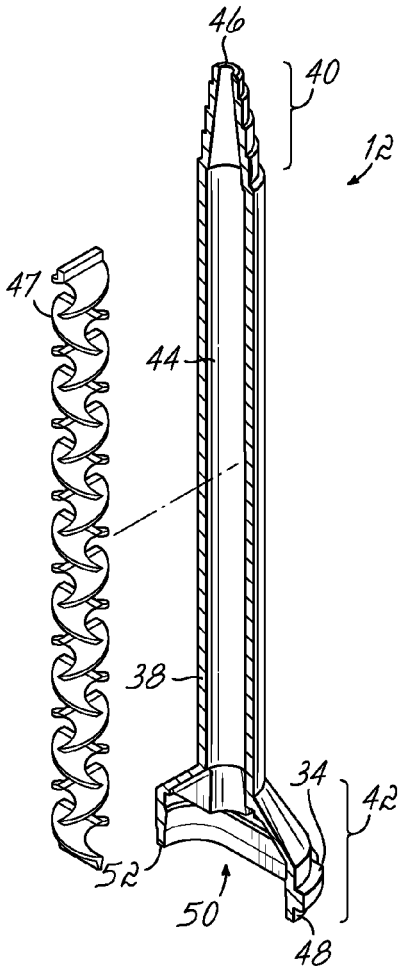
FIG. 3B is a cross-sectional view of FIG. 3A taken along section line 3B-3B.

FIGS. 3A and 3B show one embodiment of the nozzle 12 for use with the dispensing assembly 10. The nozzle 12 has a nozzle body 38 including a distal end portion 40 and a proximal end portion 42 in fluid communication via a nozzle bore 44 extending therebetween. The distal end portion 40 includes a nozzle outlet 46 in fluid communication with the nozzle bore 44. The nozzle outlet 46 is generally tapered to narrow the mixed fluid dispensed from the nozzle outlet 46 for increased precision during operation. A static mixer 47 is also positioned within the nozzle bore 44.

Figure 4:
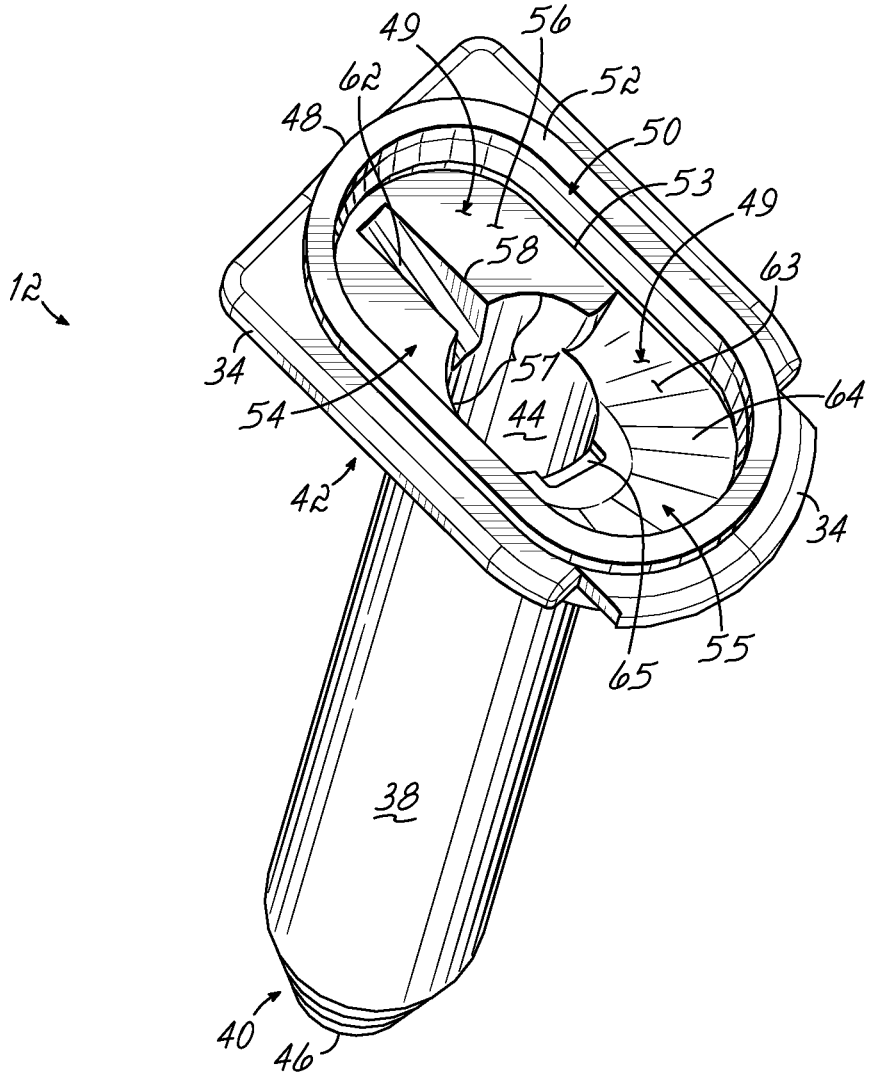
FIG. 4 is a perspective view of the nozzle according to the first embodiment of the dispensing assembly shown in FIG. 1.

FIG. 4 shows additional details of a nozzle inlet 48. The proximal end portion 42 includes a nozzle inlet 48 having an inner surface 49 and an opening 50 also in fluid communication with the nozzle bore 44. The opening 50 is defined by a peripheral edge 52 proximal of the nozzle flange 34. The peripheral edge 52 also extends distally within the nozzle inlet 48 to further define the opening 50. The opening 50 extends to an edge 53 of the inner surface 49. The inner surface 49 further extends distal of the peripheral edge 52 to define first and second cavity portions 54, 55 that are otherwise integrated into the inner surface 49. The first and second cavity portions 54, 55 have respective first and second cavity portion volumes; however, the first cavity portion volume is less than the second cavity volume.

The first cavity portion 54 is defined by a first surface portion 56 of the inner surface 49. The first surface portion 56 is bounded between the edge 53 and an inner edge 57. The inner edge 57 extends from the edge 53 and around the nozzle bore 44 so as to exclude the nozzle bore 44 within the nozzle inlet 48. According to the exemplary embodiment shown in FIG. 4, the first surface portion 56 is generally planar, but includes a channel 58. The channel 58 extends distally from the first surface portion 56 to the nozzle bore 44. More particularly, the channel 58 includes a ramped slot 62 between the opening 50 and the nozzle bore 44.

The second cavity portion 55 is defined by a second surface portion 63 of the inner surface 49. The second surface portion 63 is bounded between the edge 53 and the inner edge 57 so as to include the nozzle bore 44 within the nozzle inlet 48. According to the exemplary embodiment shown in FIG. 4, the second surface portion 63 includes a generally conical surface 64 that slopes generally from the edge 53 to the nozzle bore 44. The second surface portion 63 also includes a notch 65 that cooperates with the mixer insert 36 for ensuring that the mixer insert 36 is positioned properly within the nozzle inlet 48, as shown in FIG. 6.

Figure 6:
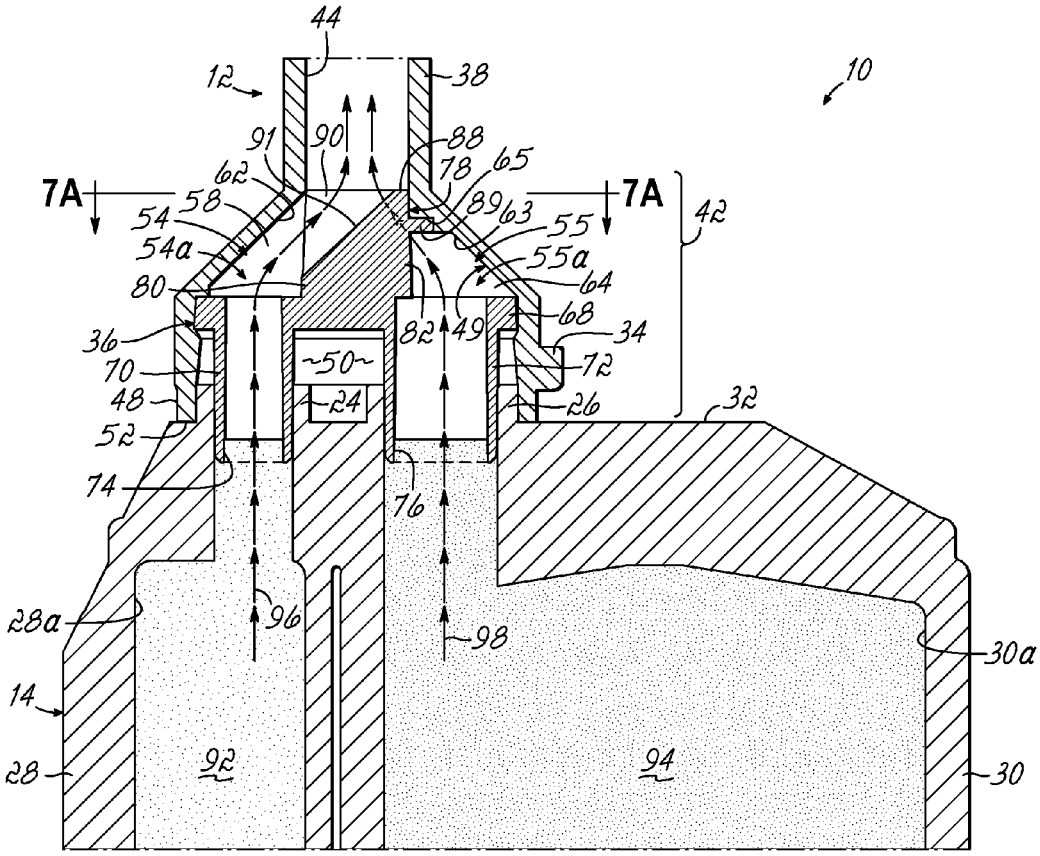
FIG. 6 is a cross-sectional view of FIG. 1 taken along section line 6-6.

With respect to FIGS. 4 and 6, the reduction of the lead-lag condition is accomplished by increasing the velocity of the smaller ratio fluid component from the cartridge 14 to the nozzle bore 44. Such increases in velocity may be accomplished by varying fluid component pressures and/or selecting appropriate geometries for the first and second cavity portions 54, 55 to create respectively small and large volume areas adapted to the predetermined ratio. Thus, as fluid components of the mixed fluid are forced into and through the first and second cavity portions 54, 55, the fluid components enter the nozzle bore 44 at generally the same time in the predetermined ratio. According to the exemplary embodiment of the nozzle inlet 48 shown in FIG. 4, the channel 58, the ramped slot 62, and the generally conical surface 64 are each integrated into the inner surface 49 of the nozzle inlet 48.

Figure 5:
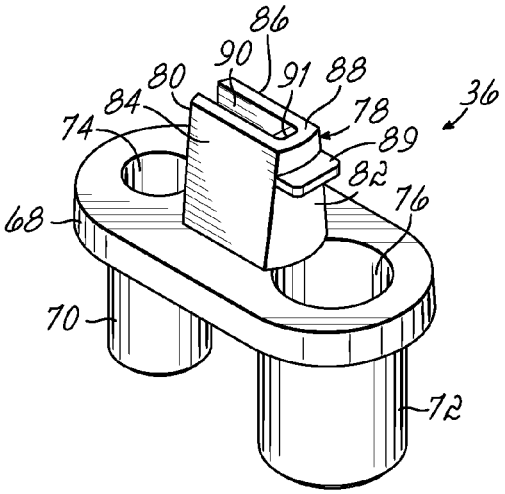
FIG. 5 is a perspective view of one embodiment of a mixer insert according to the first embodiment of the dispensing assembly shown in FIG. 1.

FIGS. 5 and 6 show the first embodiment of the mixer insert 36 for use with the nozzle 12 and the cartridge 14 for fully mixing fluid components together. With respect to the cartridge 14, the mixer insert 36 is adapted to be removably connected to the first and second outlets 24, 26. The mixer insert 36 includes a core flange 68 having first and second protrusions 70, 72 extending proximally therefrom that are adapted to seal within the first and second outlets 24, 26, respectively. First and second mixer inlets 74, 76 in the form of holes extend through the first and second protrusions 70, 72 for fluidly communicating fluid components from the cartridge 14 distal of the core flange 68.

The mixer insert 36 also includes a mixer element 78 that projects distally from the core flange 68. Generally, the geometry of both the first and second cavity portions 54, 55 in conjunction with the mixer element 78, operatively mix the fluid components as they flow from the cartridge 14 to the nozzle outlet 46. The mixer element 78 is generally positioned on the core flange 68 at least partially between the first and second mixer inlets 74, 76. The mixer element 78 further includes first and second side walls 80, 82 relatively adjacent to the first and second mixer inlets 74, 76, respectively, which are connected by a pair of lateral walls 84, 86 extending therebetween. The side walls 80, 82 and lateral walls 84, 86 each extend distally along the mixer element 78 to a mixer end 88. In order to ensure that the fluid components moving through the first and second mixer inlets 74, 76 flow into the nozzle 12 as described below, the mixer insert 36 has a detent 89 that cooperates with the notch 65 in the second surface portion 63 of the nozzle 12. According to the exemplary embodiment, if the mixer insert 36 is positioned properly within the nozzle inlet 48, the detent 89 inserts into the notch 65. However, if the mixer insert 36 is improperly positioned within the nozzle inlet 48, the detent 89 contacts the first surface portion 56 before fully inserting into the nozzle inlet 48 in order to indicate the improper position. As such, the detent 89 ensures proper orientation of the mixer insert 36 during assembly with the nozzle 12 in order to reduce the likelihood of improper assembly during the manufacturing process.

The mixer element 78 includes a mixer channel 90 extending between the pair of lateral walls 84, 86 from the first sidewall 80 through to the mixer end 88. More particularly, the mixer channel 90 includes a mixer ramped slot 91. The first mixer inlet 74 in conjunction with the mixer channel 90 and the first cavity portion 54 collectively define a first passage 54*a* as shown in more detail in FIG. 6. Also, the second mixer inlet 76 in conjunction with the pair of lateral walls 84, 86, the second sidewall 82, and the second cavity portion 55 collectively define the second passage 55*a* also shown in more detail in FIG. 6.

FIG. 6 shows the dispensing assembly 10 having the first embodiment of the mixer insert 36 positioned within the nozzle inlet 48 and cartridge 14. The cartridge 14 includes a first fluid component 92 within the first chamber 28*a* and a second fluid component 94 within the second chamber 30*a*. When pressure is applied to the first and second fluid components 92, 94, the first fluid component 92 is forced along the first flow path, indicated by arrows 96, and the second fluid component 94 is forced along the second flow path, indicated by arrows 98. As described above, the cartridge 14, the mixer insert 36, and the nozzle 12 are in fluid communication along the first and second flow paths 96, 98 so that the first and second fluid components 92, 94 may be discharged therethrough according to the predetermined ratio. With respect to the predetermined ratio, a first volume of the first fluid component 92 and a second volume of the second fluid component 94 are each discharged. Generally, the first volume being discharged is less than the second volume being discharged.

Figure 7A:
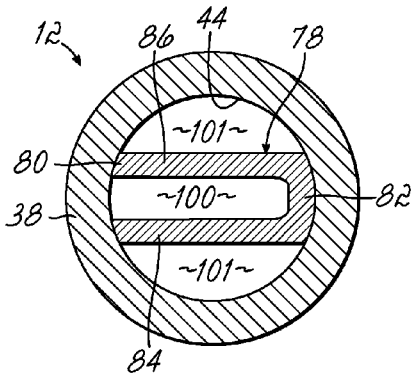
FIG. 7A is a cross-sectional view taken along section line 7A-7A of FIG. 6.

With reference to both FIG. 5 and FIG. 6, the first and second mixer inlets 74, 76 are sized to seal against the first and second outlets 24, 26. Moreover, the nozzle inlet 48 is installed over the mixer insert 36 such that the core flange 68 is within the opening 50 and against the first and second cavity portions 54, 55 within the nozzle inlet 48. The mixer element 78 extends into the nozzle inlet 48 to partition and, as described above, further define the first and second passages 54*a*, 55*a*. With respect to the first passage 54*a*, the channel 58 is aligned with the mixer channel 90 in order to define an inner portion 100 of the nozzle bore 44 within the nozzle 12, as shown in FIG. 7A. With respect to the second passage 55*a*, the second sidewall 82, the pair of lateral walls 84, 86, and the nozzle inlet 48 generally align to define an outer portion 101 of the nozzle bore 44, as shown in FIGS. 6 and 7A. The outer portion 101 at least partially and adjacently surrounds the inner portion 100. Thus, the first flow path 96 is directed generally within the second flow path 98.

Figure 7B:
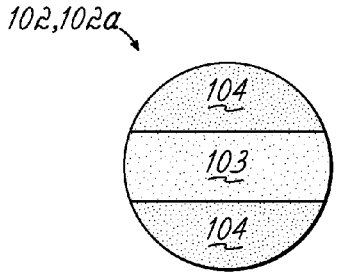
FIG. 7B is a cross-sectional view of a pre-mixed fluid as discharged from the nozzle shown in FIG. 7A.

Given that the pair of lateral walls 84, 86 and the mixer channel 90 are generally planar, the first and second fluid components 92, 94 generally discharge through the mixer channel 90 as a pre-mixed fluid 102 having a cross-section 102*a* as shown in FIGS. 6 and 7B. The pre-mixed fluid 102 includes the first fluid component 92 having a generally rectangular cross-sectional portion 103. The first fluid component 92 is then sandwiched between a pair of second fluid components 94, each of which has a generally semicircular cross-sectional portion 104, within the pre-mixed fluid 102. Thus, the nozzle inlet 48 and mixer insert 36 create the pre-mixed fluid 102 of first and second fluid components 92, 94 for entry into the static mixer 47. Such preparation of the first and second fluid components 92, 94 encourages effective diffusion of the first and second fluid components 92, 94 within the static mixer 47 to more effectively form the homogeneously mixed fluid.

Figure 8:
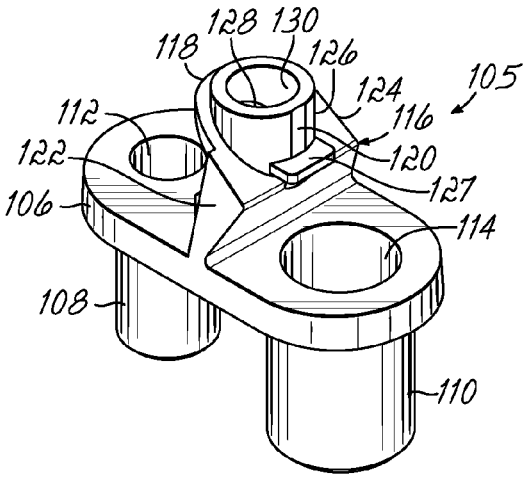
FIG. 8 is a perspective view of an alternative embodiment of a mixer insert.
Figure 9:
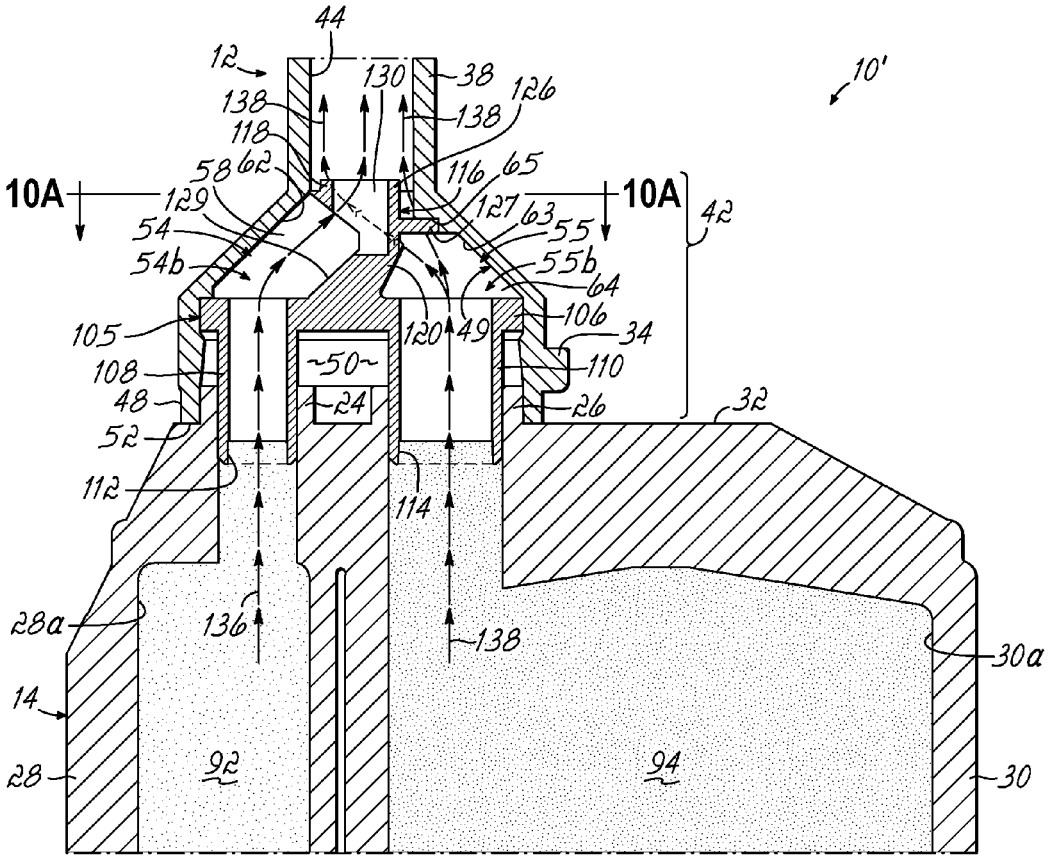
FIG. 9 is a cross-sectional view similar to FIG. 6, but illustrating use of the mixer insert shown in FIG. 8.

FIGS. 8 and 9 show the second embodiment of a mixer insert 105 for use with the nozzle 12 and the cartridge 14 for fully mixing fluid components together. With respect to the cartridge 14, the mixer insert 105 is adapted to be removably connected to the first and second outlets 24, 26. The mixer insert 105 includes a core flange 106 having first and second protrusions 108, 110 extending proximally therefrom that are adapted to insert into the first and second outlets 24, 26, respectively. First and second mixer inlets 112, 114 in the form of holes extend through the first and second protrusions 108, 110 for fluidly communicating fluid components from the cartridge 14 distal of the core flange 106.

The mixer insert 105 also includes a mixer element 116 that projects distally from the core flange 106. Generally, the geometry of both the first and second cavity portions 54, 55 in conjunction with the mixer element 116 operatively mix the fluid components as they flow from the cartridge 14 to the nozzle outlet 46. The mixer element 116 is generally positioned on the core flange 106 at least partially between the first and second mixer inlets 112, 114. The mixer element 116 further includes first and second side walls 118, 120 relatively adjacent to the first and second mixer inlets 112, 114, respectively, which are connected by a pair of lateral walls 122, 124 extending therebetween. The side walls 118, 120 and lateral walls 122, 124 each extend distally along the mixer element 116 to a mixer end portion 126. In order to ensure that the fluid components moving through the first and second mixer inlets 112, 114 flow into the nozzle 12 as described below, the mixer insert 105 has a detent 127 that cooperates with the notch 65 in the second surface portion 63 of the nozzle 12. According to the exemplary embodiment, if the mixer insert 105 is positioned properly within the nozzle inlet 48, the detent 127 inserts into the notch 65. However, if the mixer insert 105 is improperly positioned within the nozzle inlet 48, the detent 127 contacts the first surface portion 56 before fully inserting into the nozzle inlet 48 in order to indicate the improper position. As such, the detent 127 ensures proper orientation of the mixer insert 105 during assembly with the nozzle 12 in order to reduce the likelihood of improper assembly during the manufacturing process.

The mixer element 116 includes a mixer channel 128 extending between the pair of lateral walls 122, 124 from the first sidewall 118 through to the mixer end portion 126. More particularly, the mixer channel 128 includes a mixer ramped slot 129 fluidly connected to a mixer bore 130 extending through the mixer end portion 126. The first mixer inlet 112 in conjunction with the mixer channel 128 and the first cavity portion 54 collectively define another first passage 54*b*, as shown in more detail in FIG. 9. Also, the second mixer inlet 114 in conjunction with the pair of lateral walls 122, 124, the second sidewall 120, and the second cavity portion 55 collectively define another embodiment of a second passage 55*b*, also shown in more detail in FIG. 9.

FIG. 9 shows a dispensing assembly 10' having the second embodiment of the mixer insert 105 positioned within the nozzle inlet 48 and cartridge 14. The cartridge 14 includes the first fluid component 92 within the first chamber 28*a* and the second fluid component 94 within the second chamber 30*a*. When pressure is applied to the first and second fluid components 92, 94, the first fluid component 92 is forced along the first flow path, indicated by arrows 136, and the second fluid component 94 is forced along the second flow path, indicated by arrows 138. As generally described above, the cartridge 14, the mixer insert 105, and the nozzle 12 are in fluid communication along the first and second flow paths 136, 138 so that the first and second fluid components 92, 94 may be discharged therethrough. With respect to the predetermined ratio, a first volume of the first fluid component 92 and a second volume of the second fluid component 94 are each discharged. Generally, the first volume being discharged is less than the second volume being discharged.

Figure 10A:
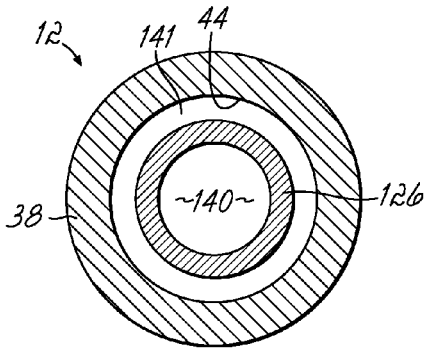
FIG. 10A is a cross-sectional view taken along section line 10A-10A of FIG. 9.

With reference to both FIG. 8 and FIG. 9, the first and second mixer inlets 112, 114 are sized to seal against the first and second outlets 24, 26. Moreover, the nozzle inlet 48 is installed over the mixer insert 105 such that the core flange 106 is within the opening 50 and against the first and second cavity portions 132, 134 within the nozzle inlet 48. The mixer element 116 extends into the nozzle inlet 48 to partition and, as described above, further define the first and second passages 54*b*, 55*b*. With respect to the first passage 54*b*, the channel 58 is aligned with the mixer channel 128 in order to define an inner portion 140 of the nozzle bore 44 within the nozzle 12, as shown in FIG. 10A. With respect to the second passage 55*b*, the second sidewall 120, the pair of lateral walls 122, 124, the mixer end portion 126, and the nozzle inlet 48 generally align to define an outer portion 141 of the nozzle bore 44, as shown in FIG. 10A. The outer portion 141 adjacently generally surrounds the inner portion 140. Thus, the first flow path 136 is directed within the second flow path 138.

Figure 10B:
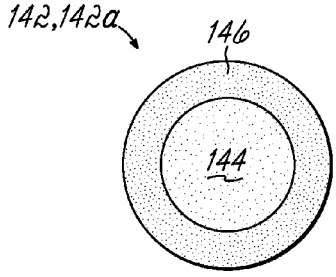
FIG. 10B is a cross-sectional view of a pre-mixed fluid as discharged from the nozzle shown in FIG. 10A.

Given that the mixer end portion 126 is generally cylindrical with the mixer bore 130 extending therethrough, the first and second fluid components 92, 94 generally discharge through the mixer channel 128 and mixer bore 130 according to a pre-mixed fluid 142 having a cross-section 142*a* as shown in FIG. 10B. The pre-mixed fluid 142 includes the first fluid component 92, having a generally circular cross-sectional portion 144, within the second fluid component 94, having a ring-like cross-sectional portion 146. Thus, the nozzle inlet 48 and mixer insert 105 create the pre-mixed fluid 142 of first and second fluid components 92, 94 for entry into the nozzle bore 44.

Figure 11A:
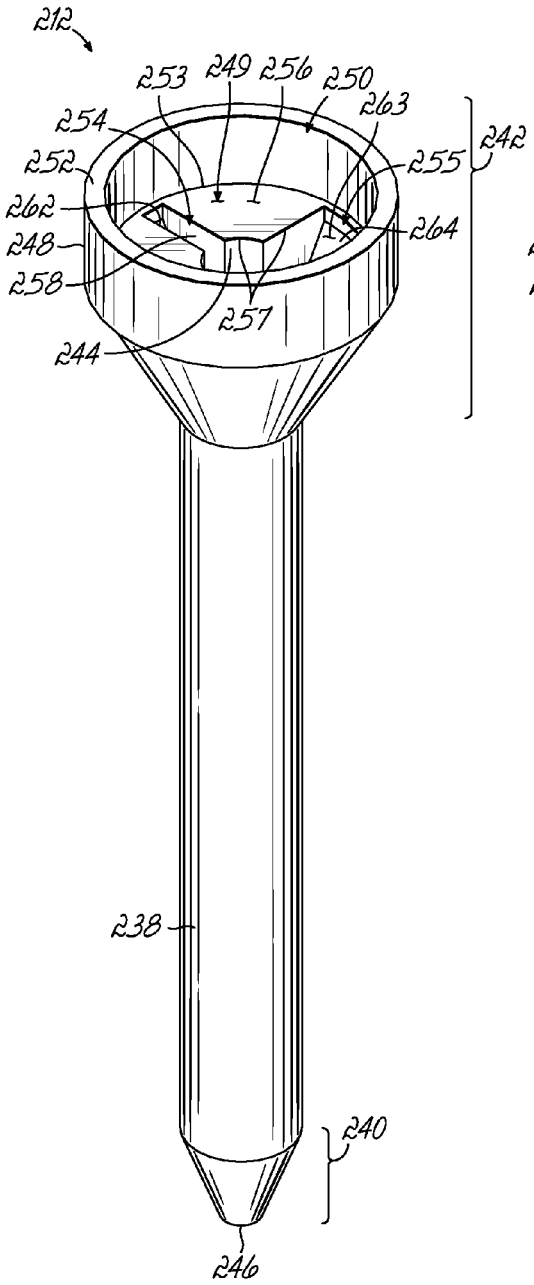
FIG. 11A is a perspective view of a second embodiment of a nozzle.
Figure 11B:
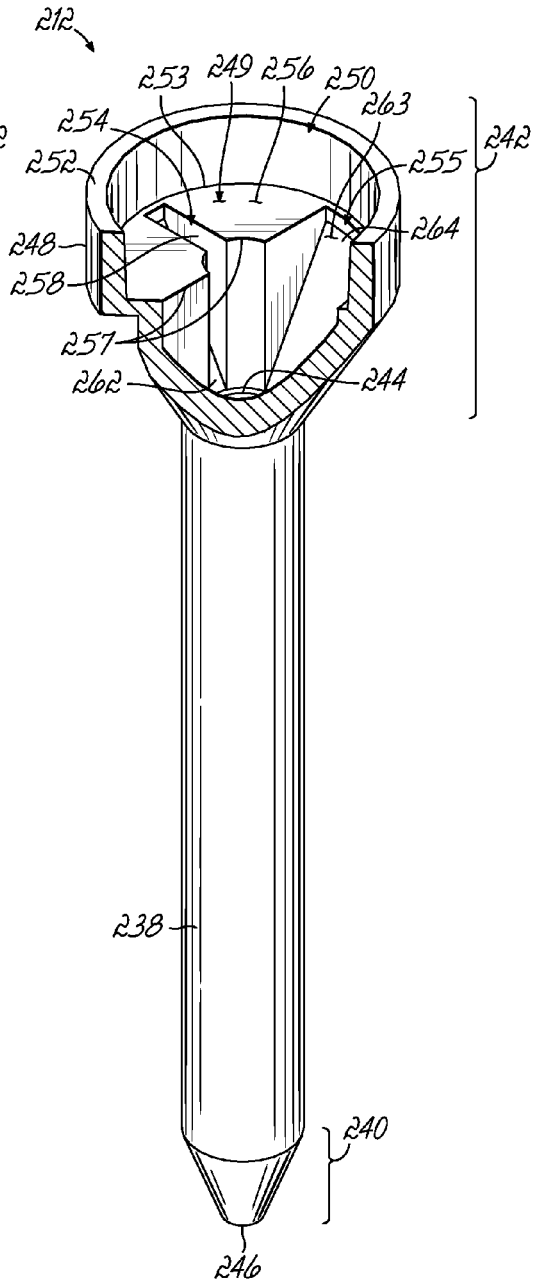
FIG. 11B is a fragmented view of the nozzle shown in FIG. 11A to better illustrate the inlet of the nozzle.

FIGS. 11A and 11B show a second alternative embodiment of a nozzle 212. For example, the nozzle 212 may be used with an alternative cartridge, not shown in the figures, having a single outlet port sub-divided into semicircular first and second outlets that are D-shaped and positioned back-to back. The nozzle 212 has a nozzle body 238 that is generally cylindrical and has a distal end portion 240 and a proximal end portion 242 in fluid communication via a nozzle bore 244 extending therethrough. The nozzle bore 244 is also generally cylindrical. The distal end portion 240 includes a nozzle outlet 246 in fluid communication with the nozzle bore 244. The nozzle outlet 246 is generally tapered to narrow the mixed fluid dispensed from the nozzle outlet 246 for increased precision during operation. The proximal end portion 242 includes a nozzle inlet 248 having an inner surface 249 and an opening 250 also in fluid communication with the nozzle bore 244.

The opening 250 is defined by a peripheral edge 252 proximal of the nozzle flange 234. The peripheral edge 252 also extends distally within the nozzle inlet 248 to further define the opening 250. The opening 250 extends to an edge 253 of the inner surface 249. The inner surface 249 further extends distal of the peripheral edge 252 to define first and second cavity portions 254, 255 that are otherwise integrated into the inner surface 249. The first and second cavity portions 254, 255 have respective first and second cavity portion volumes. The volume of the first cavity portion 260 is less than the volume of the second cavity portion volume 266. In addition, the nozzle 212 may include an indicator feature (not shown) adapted to ensure proper alignment of the first and second cavity portions 254, 255 to the respective semicircular first and second outlets.

The first cavity portion 254 is defined by a first surface portion 256 of the inner surface 249. The first surface portion 256 is bounded between the edge 253 and an inner edge 257.

The inner edge 257 extends from the edge 253 and around the nozzle bore 244 so as to exclude the nozzle bore 244 within the nozzle inlet 248. According to the exemplary embodiment shown in FIGS. 11A and 11B, the first surface portion 256 is generally planar, but includes a deep channel 258. The deep channel 258 extends distally from the first surface portion 256 to the nozzle bore 244. More particularly, the deep channel 258 includes a deep ramped slot 262 between the opening 250 and the nozzle bore 244.

The second cavity portion 255 is defined by a second surface portion 263 of the inner surface 249. The second surface portion 263 is bounded between the edge 253 and the inner edge 257 so as to include the nozzle bore 244 within the nozzle inlet 248. According to the exemplary embodiment shown in FIGS. 11A and 11B, the second surface portion 263 includes a deep generally conical surface 264 that slopes generally from the edge 253 to the nozzle bore 244.

Generally, the reduction of the lead-lag condition is accomplished by increasing the velocity of the smaller ratio fluid component from the cartridge 14 (see FIG. 6 and FIG. 8) to the nozzle bore 244. Such increases in velocity may be accomplished by varying fluid component pressures and/or selecting appropriate geometries for the first and second cavity portions 254, 255 to create respectively small and large volumes adapted to the predetermined ratio. Thus, as fluid components of the mixed fluid are forced into and through the first and second cavity portions 254, 255, the fluid components enter the nozzle bore 244 at generally the same time in the predetermined ratio.

According to the exemplary embodiment of the nozzle inlet 248 shown in FIGS. 11A and 11B, the deep channel 258, the deep ramped slot 262, and the deep generally conical surface 264 are each integrated into inner surface 249 of the nozzle inlet 248. Furthermore, with reference to FIGS. 4, 11A, and 11B, the deep channel 258 with the deep ramped slot 262 and the deep generally conical surface 264 each extend further along the generally cylindrical nozzle bore 244 than the channel 58 with the ramped slot 62 and the generally conical surface 64 of the first embodiment of the nozzle 12. Thereby, the nozzle 212 may accommodate various types of static mixers 47 (see FIG. 3B) for mixing various fluid components requiring such geometrical differences.

Figure 12A:
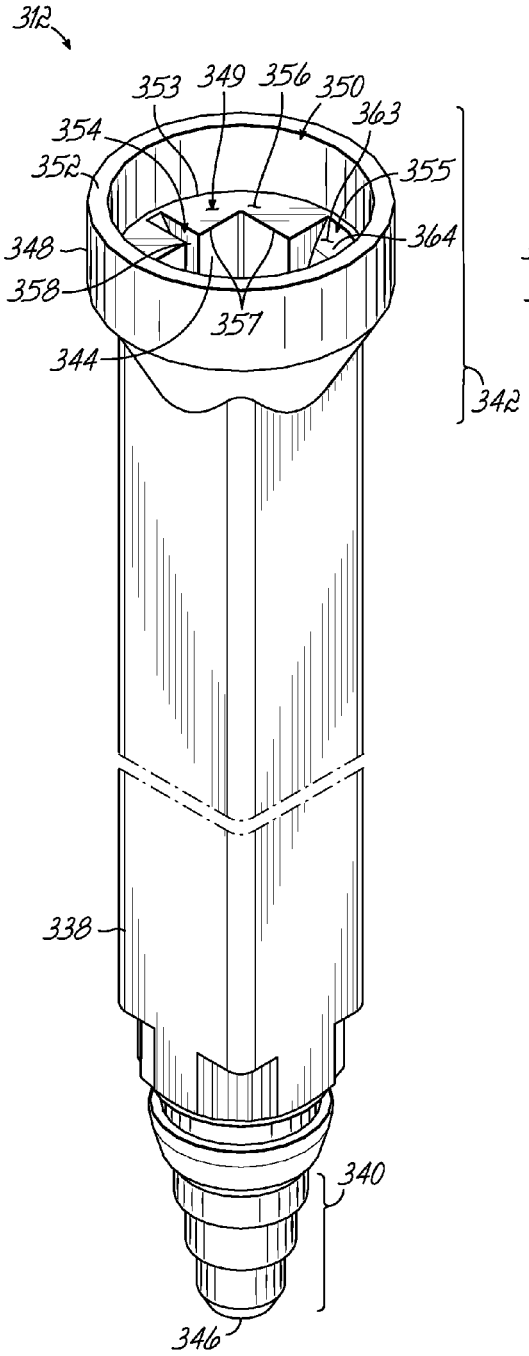
FIG. 12A is a perspective view of a third embodiment of a nozzle.
Figure 12B:
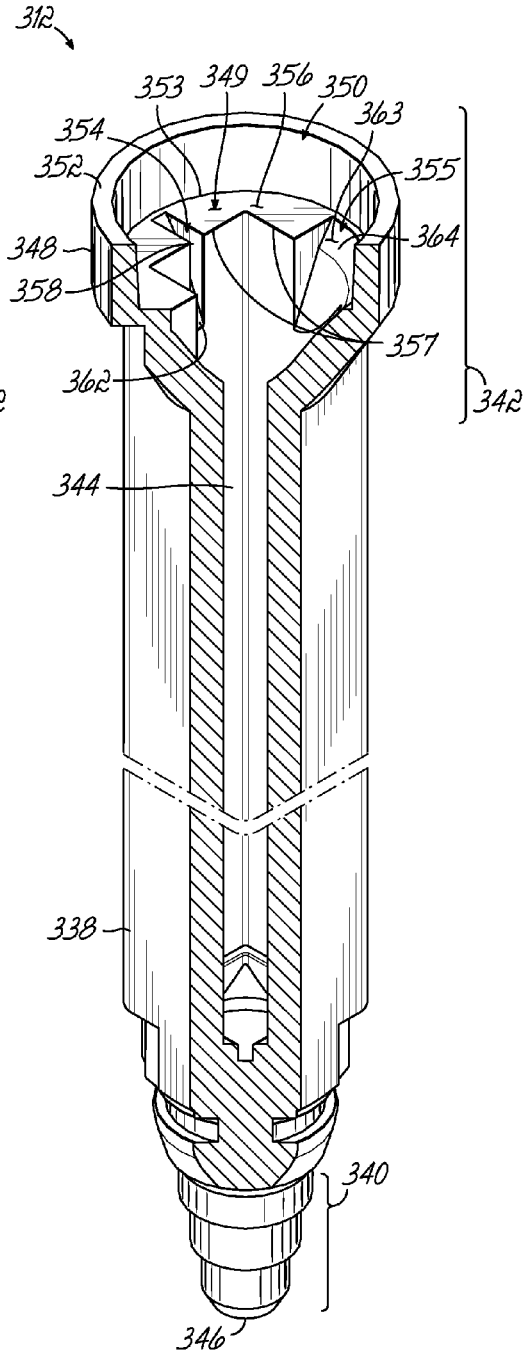
FIG. 12B is a fragmented view of the nozzle shown in FIG. 12A to better illustrate the inlet and the bore of the nozzle.

FIGS. 12A and 12B show a third alternative embodiment of a nozzle 312. For example, the nozzle 312 may be used with the alternative cartridge, not shown in the figures, having the single outlet port sub-divided into semicircular first and second outlets that are D-shaped and positioned back-to back. The nozzle 312 has a nozzle body 338 that is generally a rectangular cuboid and has a distal end portion 340 and a proximal end portion 342 in fluid communication via a nozzle bore 344 extending therethrough. The nozzle bore 344 is also generally a rectangular cuboid. The distal end portion 340 includes a nozzle outlet 346 in fluid communication with the nozzle bore 344. The nozzle outlet 346 is generally tapered to narrow the mixed fluid dispensed from the nozzle outlet 346 for increased precision during operation. The proximal end portion 342 includes a nozzle inlet 348 having an inner surface 349 and an opening 350 also in fluid communication with the nozzle bore 344.

The opening 350 is defined by a peripheral edge 352 proximal of the nozzle flange 334. The peripheral edge 352 also extends distally within the nozzle inlet 348 to further define the opening 350. The opening 350 extends to an edge 353 of the inner surface 349. The inner surface 349 further extends distal of the peripheral edge 352 to define first and second cavity portions 354, 355 that are otherwise integrated into the inner surface 349. The first and second cavity portions 354, 355 have respective first and second cavity portion volumes. The volume of the first cavity portion 354 is less than the volume of the second cavity portion 355. In addition, the nozzle 312 may include an indicator feature (not shown) adapted to ensure proper alignment of the first and second cavity portions 354, 355 to the respective semicircular first and second outlets.

The first cavity portion 354 is defined by a first surface portion 356 of the inner surface 349. The first surface portion 356 is bounded between the edge 353 and an inner edge 357. The inner edge 357 extends from the edge 353 and around the nozzle bore 344 so as to exclude the nozzle bore 344 within the nozzle inlet 348. According to the exemplary embodiment shown in FIGS. 12A and 12B, the first surface portion 356 is generally planar, but includes a shallow channel 358. The shallow channel 358 extends distally from the first surface portion 356 to the nozzle bore 344. More particularly, the shallow channel 358 includes a shallow ramped slot 362 between the opening 350 and the nozzle bore 344.

The second cavity portion 355 is defined by a second surface portion 363 of the inner surface 349. The second surface portion 363 is bounded between the edge 353 and the inner edge 357 so as to include the nozzle bore 344 within the nozzle inlet 348. According to the exemplary embodiment shown in FIGS. 12A and 12B, the second surface portion 363 includes a shallow generally conical surface 364 that slopes generally from the edge 353 to the nozzle bore 344.

Generally, the reduction of the lead-lag condition is accomplished by increasing the velocity of the smaller ratio fluid component from the cartridge 14 (see FIGS. 6 and 8) to the nozzle bore 344. Such increases in velocity may be accomplished by varying fluid component pressures and/or selecting appropriate geometries for the first and second cavity portions 354, 355 to create respectively small and large volumes adapted to the predetermined ratio. Thus, as fluid components of the mixed fluid are forced into and through the first and second cavity portions 354, 355, the fluid components enter the nozzle bore 344 at generally the same time in the predetermined ratio.

According to the exemplary embodiment of the nozzle inlet 348 shown in FIGS. 12A and 12B, the shallow channel 358, the shallow ramped slot 362, and the shallow generally conical surface 364 are each integrated into the inner surface 349 of the nozzle inlet 348. Furthermore, with reference to FIGS. 4, 12A, and 12B, the shallow channel 358 with the shallow ramped slot 362 and the shallow generally conical surface 364 each extend further along the generally cylindrical nozzle bore 344 than the channel 58 with the ramped slot 62 and the generally conical surface 64 of the first embodiment of the nozzle 12. Thereby, the nozzle 312 may accommodate various types of static mixers 47 (see FIG. 3B) for mixing various fluid components requiring such geometrical differences.

Operation

With reference to FIGS. 1, 2, 6, 7A, and 7B, in use, the mixer insert 36 is positioned within the nozzle inlet 48 to collectively define the first and second passages 54*a*, 55*a*. The nozzle 12 is attached to the cartridge 14 by sliding the coupling 16 to connect both the nozzle 12 and the cartridge 14 to form the dispensing assembly 10. Pressure is applied to the first and second fluid components 92, 94 with the first and second chambers 28*a*, 30*a*. More particularly, the first and second fluid components 92, 94 may be simultaneously pressurized to force the first and second fluid components 92, 94 along the first and second flow paths 136, 138, respectively. Traveling along these flow paths, 136, 138, the first and second fluid components 92, 94 discharge through the first and second mixer inlets and into the respective first and second passages 54*a*, 55*a*.

The first fluid component 92 is forced from the first passage 54*a* and through the channel 58 toward the nozzle bore 44. Along the channel 58, the first fluid component 92 is directed along the ramped slot 62 in order to pass the first fluid component 92 into the nozzle bore 44. The second fluid component 94 is directed along the generally conical surface 64 from the second passage 55*a* and into the nozzle bore 44. The first fluid component 92 increases in velocity as it passes through the first passage 54*a* relative to the second fluid component 94 passing through the second passage 55*a*. Thus, the lead-lag condition between the first and second fluid components directed toward the nozzle bore 44 is reduced or generally prevented altogether.

With respect to the first embodiment of the mixer insert 36 within the nozzle inlet 48, the first fluid component 92 is further forced from the channel 58 into the mixer channel 90 and along the mixer ramped slot 91. The first fluid component 92 exits the mixer ramped slot 91 of the first passage 54*a* at the inner portion 100 of the nozzle bore 44. Furthermore, the second fluid component 94 exits the second passage 55*a* at the outer portion 101 of the nozzle bore 44. The first and second fluid components 92, 94 form the pre-mixed fluid 102 having the cross-section 102*a* such that the first fluid component 92 is layered as a generally planar layer between layers of the second fluid component 94. More particularly, the first fluid component 92 is forced along the first flow path 96 into the generally rectangular cross-sectional portion 103 adjacent to the second fluid component 94 forced along the second flow path 98 into the generally semicircular cross-sectional portions 104. The second fluid component 94 at least partially and adjacently surrounds the first fluid component 92 according to the predetermined ratio.

With respect to the second embodiment of the mixer insert 105 within the first and second cavity portions 54, 55 shown FIGS. 9, 10A and 10B, the first fluid component 92 is further forced from the channel 58 into the mixer channel 90 and into the mixer bore 130. The first fluid component 92 exits the mixer bore 130 of the first passage 54*b* at the inner portion 140 of the nozzle bore 44. Furthermore, the second fluid component 94 exits the second passage 55*b* at the outer portion 141 of the nozzle bore 44. The first and second fluid components 92, 94 form the pre-mixed fluid 142 having the cross-section 142*a*. More particularly, the first fluid component 92 is forced along the first flow path 136 into the circular cross-sectional portion 144 adjacent to the second fluid component 94 forced along the second flow path 138 into the ring-like cross-sectional portion 146. The second fluid component 94 adjacently generally surrounds the first fluid component 92 according to the predetermined ratio.

Regardless of whether the mixer insert 36 of FIG. 6 or the mixer insert 105 of FIG. 9 is used in conjunction with the dispensing assembly 10 or the dispensing assembly 10', the pre-mixed fluid enters the static mixer 47 and travels distally along the length of the nozzle 12 shown in FIG. 3B. The pre-mixed fluid is then mixed into the mixed fluid and dispensed from the nozzle outlet 46.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. For example, it will be appreciated that the first and second fluid components 92, 94 may be layered in other positions or number of layers with another mixer insert in accordance with the invention described herein. The invention in its broader aspects is therefore not limited to the specific details, representative dispensing assembly and method and illustrative examples shown and described. Accordingly, departures may be from such details without departing from the scope or spirit of the general inventive concept.

What is claimed is:

1. A nozzle for reducing or preventing a lead-lag condition while dispensing a mixture of a first fluid component and a second fluid component, comprising;

a nozzle body having a nozzle inlet and a nozzle bore extending therethrough, the nozzle inlet including a first cavity portion adapted to receive the first fluid component and a second cavity portion adapted to receive the second fluid component, the first and second cavity portions respectively extending from the nozzle inlet to a first inner surface and a second inner surface, the first and second inner surfaces being bounded between the nozzle inlet and the nozzle bore such that the first cavity portion defines a first cavity volume and the second cavity portion defines a second cavity volume, and the first cavity volume is smaller than the second cavity volume; and a channel extending through the first inner surface to the nozzle bore that further defines the first cavity portion, wherein the first cavity portion is configured to direct the first fluid component into the nozzle bore and the second cavity portion is configured to direct the second fluid component into the nozzle bore with the first fluid component, according to a predetermined ratio between the first and second fluid components.

2. The nozzle of claim 1 wherein the second inner surface has a generally conical surface for directing the second fluid component into the nozzle bore.

3. The nozzle of claim 1 wherein the nozzle inlet is configured to receive a mixer insert at least partially inserted therein that, in conjunction with the first and second inner surfaces, collectively defines a first passage through the first cavity volume and a second passage through the second cavity volume for directing the first and second fluid components through the first and second passages, respectively.

4. The nozzle of claim 3 wherein the nozzle inlet is configured to removably receive the mixer insert therein.

5. A dispensing assembly for reducing or preventing a lead-lag condition while dispensing a mixture of a first fluid component and a second fluid component, comprising;

a first barrel having first chamber, a second barrel having a second chamber, the first and second chambers for containing the first and second fluid components;

a mixer insert having a first and a second mixer inlet, the first and second mixer inlets respectively in fluid communication with the first and second chamber;

a nozzle, including a nozzle body having a nozzle inlet and a nozzle bore extending therethrough, the nozzle inlet having a first cavity portion and a second cavity portion, the first and second cavity portions respectively extending from the nozzle inlet to a first inner surface and a second inner surface, the first and second inner surfaces being bounded between the nozzle inlet and the nozzle bore such that the first cavity portion defines a first cavity volume and the second cavity portion defines a second cavity volume, the first cavity volume is smaller than the second cavity volume, and the nozzle inlet receives the mixer insert at least partially therein to fluidly separate the first and second cavity portions;

a channel extending through the first inner surface to the nozzle bore that further defines the first cavity portion;

a first passage collectively defined between the mixer insert and the first inner surface, the first passage configured to direct the first fluid component along the channel and into the nozzle bore; and a second passage collectively defined by the mixer insert and the second inner surface, the second passage configured to direct the second fluid component into the nozzle bore, wherein the first and second passages are adapted to direct the first and second fluid components into the nozzle bore to form a pre-mixed fluid having a predetermined ratio of first and second fluid components, the nozzle being adapted to mix the pre-mixed fluid for dispensing a mixed fluid from the nozzle.

6. The dispensing assembly of claim 5 wherein the second inner surface has a generally conical surface for directing the second fluid component into the nozzle bore.

7. The dispensing assembly of claim 5 wherein the nozzle inlet removably receives the mixer insert therein.

8. The dispensing assembly of claim 5 wherein the mixer insert has a mixing element, the first and second passages adapted for respectively forming the first and second fluid components into the pre-mixed fluid having a cross-section, the cross-section having a generally rectangular cross-sectional portion of the first fluid component sandwiched between a pair of generally semicircular cross-sectional portions of the second fluid component.

9. The dispensing assembly of claim 5 wherein the mixer insert has a mixing element, the first and second passages adapted for respectively forming the first and second fluid components into the pre-mixed fluid having a cross-section, the cross-section having a generally circular cross-sectional portion of the first fluid component at least partially surrounded by a generally ring-like cross-sectional portion of the second fluid component.

10. A method for reducing or preventing a lead-lag condition with a mixer insert at least partially positioned within a nozzle inlet while dispensing a mixture of a first fluid component and a second fluid component from a nozzle bore of a nozzle, the nozzle inlet includes a first cavity portion and a second cavity portion extending from the nozzle inlet to a first inner surface and a second inner surface, the method comprising;

forcing the first and second fluid components through the mixer insert and into a first passage and a second passage, respectively, the first passage defined between the mixer insert and the first inner surface, the second passage defined between the mixer insert and the second inner surface of the nozzle inlet, the first and second inner surfaces being bounded between the nozzle inlet and the nozzle bore to define a first cavity volume and a second cavity volume, respectively, and the first cavity volume is smaller than the second cavity volume;

forcing the first fluid component through the first passage and along a channel extending through the first inner surface to the nozzle bore;

forcing the second fluid component through the second passage and into the nozzle bore;

increasing the velocity of the first fluid component for generally preventing the lead-lag condition;

positioning the first fluid component adjacent to the second fluid component in a nozzle bore of the nozzle for forming a pre-mixed fluid;

mixing the pre-mixed fluid into a mixed fluid; and dispensing the mixed fluid from the nozzle.

11. The method of claim 10 wherein the second inner surface has a generally conical surface, and the method further comprises:

directing the second fluid component along the generally conical surface and into the nozzle bore.

12. The method of claim 10 further comprising layering the first and second fluid components against each other to form the pre-mixed fluid.

13. The method of claim 12 wherein the layer of the first fluid component is generally planar between layers of the second fluid component.

14. The method of claim 12 wherein the layer of the second fluid component generally surrounds the layer of the first fluid component.

15. The nozzle of claim 1 further comprising:

a notch defined by a portion of the nozzle inlet and configured to cooperate with the mixer insert to align the mixer insert to a predetermined position relative to the nozzle inlet.

16. The nozzle of claim 1 wherein the first inner surface is generally planar.

17. The nozzle of claim 5 further comprising:

a notch defined by a portion of the nozzle inlet and configured to cooperate with the mixer insert to align the mixer insert to a predetermined position relative to the nozzle inlet.

18. The nozzle of claim 5 wherein the first inner surface is generally planar.

* * * * *